US012593890B2

(12) United States Patent
Mayers et al.

(10) Patent No.: US 12,593,890 B2
(45) Date of Patent: Apr. 7, 2026

(54) SHOE SOLE HAVING RECESSED POCKETS

(71) Applicant: ON CLOUDS GMBH, Zürich (CH)

(72) Inventors: Scott Ryan Mayers, Zürich (CH); Silvano Spada, Zürich (CH); Martin Rüegg, Zürich (CH); Elias Miguel Ortiz, Zürich (CH)

(73) Assignee: ON CLOUDS GMBH, Zurich (CH)

( * ) Notice: Subject to any disclaimer, the term of this patent is extended or adjusted under 35 U.S.C. 154(b) by 15 days.

(21) Appl. No.: 18/854,821

(22) PCT Filed: Apr. 4, 2023

(86) PCT No.: PCT/EP2023/058825
§ 371 (c)(1),
(2) Date: Oct. 7, 2024

(87) PCT Pub. No.: WO2023/198524
PCT Pub. Date: Oct. 19, 2023

(65) Prior Publication Data

US 2025/0255378 A1 Aug. 14, 2025

(30) Foreign Application Priority Data

Apr. 14, 2022 (CH) ..... 000443/2022

(51) Int. Cl.
*A43B 13/12* (2006.01)
*A43B 13/18* (2006.01)

(52) U.S. Cl.
CPC ..... *A43B 13/125* (2013.01); *A43B 13/18* (2013.01)

(58) Field of Classification Search
CPC ..... A43B 13/125; A43B 13/127; A43B 13/18; A43B 13/186; A43B 13/141
(Continued)

(56) References Cited

U.S. PATENT DOCUMENTS

2004/0154189 A1* 8/2004 Wang ..... A43B 13/12 36/28
2005/0034328 A1* 2/2005 Geer ..... A43B 3/0052 36/31

(Continued)

FOREIGN PATENT DOCUMENTS

EP 1 447 020 A1 8/2004
EP 1 882 421 A2 1/2008

(Continued)

OTHER PUBLICATIONS

EPO (Rijswijk, NL), English version of the International Search Report, Form PCT/ISA/210, for corresponding International Application PCT/EP2023/058825, Jul. 5, 2023 (3 pp.).

*Primary Examiner* — Haley A Smith
(74) *Attorney, Agent, or Firm* — Pauley Erickson & Swanson

(57) ABSTRACT

A shoe sole (1) for a sport shoe, the shoe sole including a midsole (2) with a forefoot area, a heel area and a midfoot area being arranged between the forefoot area and the heel area. The midsole includes a heel edge (21) and a midsole tip (22), wherein a longitudinal direction (LO) of the midsole (2) extends from the heel edge (21) to the midsole tip (22). The midsole further includes a top layer (23) and a base layer (24), wherein the midsole defines a plurality of recessed pockets (25*a*, 25*b*, 25*c*, 25*d*, 25*e*) which are open towards the top layer and wherein at least a some of the recessed pockets (25*a*, 25*b*, 25*c*, 25*d*, 25*e*) are in the longitudinal direction (LO) arranged one after another.

16 Claims, 4 Drawing Sheets

(58) Field of Classification Search
USPC ..... 36/107, 108
See application file for complete search history.

(56) References Cited

U.S. PATENT DOCUMENTS

| | | | | |
|---|---|---|---|---|
| 2008/0052965 | A1* | 3/2008 | Sato | A43B 13/026 36/103 |
| 2011/0146110 | A1 | 6/2011 | Geer | |
| 2014/0250723 | A1* | 9/2014 | Kohatsu | A43B 13/141 36/28 |
| 2015/0052782 | A1 | 2/2015 | Christensen et al. | |
| 2020/0093223 | A1* | 3/2020 | Iuchi | A43B 13/16 |

FOREIGN PATENT DOCUMENTS

| | | | |
|---|---|---|---|
| EP | 2 764 788 | A1 | 8/2014 |
| EP | 3 104 732 | A1 | 12/2016 |
| EP | 3 704 987 | A1 | 9/2020 |
| WO | WO 2015/122978 | A1 | 8/2015 |
| WO | WO 2019/169124 | A1 | 9/2019 |

* cited by examiner

SHOE SOLE HAVING RECESSED POCKETS

CROSS REFERENCE TO RELATED APPLICATION

This application is a National Phase filing in the United States, under 35 USC § 371, of PCT International Patent Application PCT/EP2023/058825, filed on 4 Apr. 2023 which claims the priority of Swiss Patent Application No. CH 000443/2022, filed 14 Apr. 2022.

The above-referenced applications are hereby incorporated by reference herein in their entirety and are made a part hereof, including but not limited to those portions which specifically appear hereinafter.

BACKGROUND OF THE INVENTION

Field of the Invention

The present invention lies in the field of shoe technology and relates to a shoe sole for sport shoes, such as running shoes or particularly gymnastic or cross-fit shoes.

Discussion of Related Art

Soles for sport shoes typically comprise different cushioning systems. Relevant cushioning systems known in the prior art relate to channels which enable cushioning, spring elements, such as vertically extending dampers, or fluid filled chambers, e.g. chambers which are filled with a gel or with enclosed air. The majority of such cushioning systems focus on the forces which occur during long or medium distance running in which vertical acting forces predominate. In addition, when running downhill also forces acting horizontally, i.e. along a longitudinal direction of the shoe sole occur.

However, in other sports, in particular in cross-fit or gymnastics, the sportsperson does not only perform unidirectional movements as it is the case for long or medium distance running, but also other movements, such as side steps, jumps, lunges, squats and the like, which are not unidirectional, but also entail laterally or medially acting forces on the wearer's foot. Furthermore, as cushioning typically requires a certain degree of flexibility, many cushioning systems known in the prior art evoke instabilities, in particular in the medial and lateral directions. While this is not a significant issue for unidirectional running, it is a profound disadvantage for other activities as mentioned above, in particular as such instabilities may cause severe foot injuries.

Furthermore, as cushioning requires a certain flexibility, it typically leads to a less efficient force transmission. As an example, if a sportsperson jumps, not all of the body force is used for the push-off, as a certain part will be absorbed by the cushioning system. Therefore, it would be desirable not only to provide efficient cushioning, but also to allow for an efficient force transmission into the desired movement.

SUMMARY OF THE INVENTION

It is therefore the general object of the present invention to advance the state of the art of sole technology and preferably overcome the above mentioned disadvantages fully or partly. Advantageously a shoe sole is provided which allows for a better cushioning. Preferably, a sole is provided which allows for efficient cushioning of vertical forces, but preferably also of horizontal forces, in particular against the longitudinal direction and/or medially and laterally acting horizontal forces. In advantageous embodiments, a sole is provided which enables an efficient force transfer during push-off. In further advantageous embodiments, a sole is provided which allows to prevent foot injuries, in particular ankle injuries, caused by twisting the wearer's foot.

The general object is achieved by the subject-matter of the independent claim. Further advantageous embodiments follow from the dependent claims and the overall disclosure.

A first aspect of the invention relates to a shoe sole for a sport shoe, in particular for a gymnastic or cross-fit shoe, comprising a midsole. The midsole of the shoe sole comprises a forefoot area, a heel area and a midfoot area. The midfoot area is arranged between the forefoot area and the heel area. The midsole further comprises a midsole tip, i.e. the part of the midsole which in the operating state points into the walking direction, and a heel edge. The longitudinal direction of the midsole extends from the heel edge to the midsole tip. Thus, along the longitudinal direction, the midsole tip and the heel edge represent the two opposing end portions of the midsole. The midsole further comprises a top layer and a base layer, which are typically opposing each other. The vertical direction of the midsole, respectively of the shoe sole extends from the base layer to the top layer and thus the top layer is arranged above the base layer and in the operative state closer to the wearer's foot. The midsole defines a plurality of recessed pockets which are open towards the top layer of the midsole. At least a portion, i.e. at least some or all of the recessed pockets are in the longitudinal direction arranged one after another.

As the skilled person understands, recessed pockets are indentations in the midsole which are open to the top layer, i.e. which are open when viewed on the top layer of the midsole. However, such pockets are closed towards the base layer, i.e. they are not visible when viewed on the base layer of the midsole. Thus, the recessed pockets may be considered as blind holes. Typically, the recessed pockets are defined by wall portions and in particular by one or more vertically extending wall portions and a single horizontally extending wall portion. The horizontally extending wall portion is essentially parallel to the base layer of the midsole and represents the bottom of the corresponding recessed pocket. The pocket does usually not have an additional horizontally extending wall portion and thus it is only defined by the vertical wall portions and the bottom wall portion. Typically, the vertical wall portions completely circumferentially surround, respectively delimit, the recessed pocket, e.g. with respect to the horizontal plane defined by the transverse and longitudinal direction.

Such recessed pockets are typically defined by the midsole and have the advantage that they provide for an efficient cushioning, but due to their vertical wall portions, provide also for a high stability in the medial and lateral direction and thus avoid ankle twisting.

The midsole is typically made from an elastic material, in particular a viscoelastic polymer foam, such a EVA, TPU, expanded TPU, polyamide or polyether block amide (PEBAX).

In preferred embodiments, the recessed pockets are separate recessed pockets. This means, each recessed pocket is separated and not connected with other recessed pockets. Typically, each of the separate recessed pockets is circumferentially delimited by wall portions, particularly vertically extending wall portions. These wall portions preferably completely delimit the recessed pockets in the plane defined by the transversal and the longitudinal direction. In certain embodiments, all vertically extending wall portions which define a given recessed pocket have the same height, i.e. extension in the vertical direction. However, it may in certain embodiments be possible that the height of vertically extending wall portions which define different recessed pockets have the same or different heights.

In some embodiments, the recessed pockets are configured such that they partially collapse upon landing, i.e. upon tread. Preferably, they are configured such that the only partially collapse, i.e. they do not fully collapse upon tread, particularly during running. The term "upon landing", respectively "upon tread" refers to the acting forces when an 80 kg male individual with shoe size US 10 runs and lands on one foot while the other foot is in the air.

Directional indications as used in the present disclosure are to be understood as follows: The longitudinal direction LO of the midsole, respectively the shoe sole, is described by an axis from the heel area, respectively from the heel edge, to the forefoot area, respectively to the midsole tip, and thus extends along the longitudinal axis of the midsole. Thus, the term "extending along/in the longitudinal direction" typically refers to extending towards the midsole tip and the term "extending against the longitudinal direction" typically refers to extending towards the heel edge. The transverse direction TR of the midsole respectively the shoe sole, extends transversely to the longitudinal axis and substantially parallel to the base layer of the midsole, or substantially parallel to the ground in the operative state. Thus, the transverse direction runs along a transverse axis of the midsole. In the context of the present invention, the vertical direction V denotes a direction from the base layer to the top layer of the midsole in the direction of the insole, or in the operative state in the direction of the foot of the wearer, and thus runs along a vertical axis of the midsole respectively the shoe sole. Thus, the term "extending along/in the vertical direction" typically refers to extending towards the top layer of the midsole and the term "extending against the vertical direction" typically refers to extending towards the base layer of the midsole. The longitudinal direction, the vertical direction and the transverse direction may all be perpendicular to each other. The lateral side of the midsole is the outer perimeter of the midsole between the heel edge and the sole tip, which in the worn state rests against the outer instep of the wearer's foot. The indication "horizontal" refers to a plane extending in the longitudinal and the transverse direction and being perpendicular to the vertical direction. The medial side of the midsole, refers to the inner perimeter of the midsole between the heel edge and the sole tip, which is located opposite the lateral side. Thus, in a pair of worn running shoes, the medial sides of the two running shoes face each other and the lateral sides face away from each other. Furthermore, the midsole may typically along the longitudinal direction be divided into a forefoot area, a heel area and a midfoot area being arranged between the forefoot area and the heel area. For example, the forefoot area extends from the midsole tip against, i.e. opposite, the longitudinal direction to 30-45% of the total length of the midsole in the longitudinal direction. The heel area extends, for example, from the heel edge in the longitudinal direction to 20-30% of the total length of the midsole in the longitudinal direction. The midfoot area extends directly between the heel area and the forefoot area, such that the length in the longitudinal direction of the midfoot area makes up the remaining portion of the total length, particularly from 15-50% of the total length.

In some embodiments, the shoe sole may consist of the midsole. In other embodiments, in particular in embodiments as described further below, the shoe sole comprises in addition to the midsole other components, such as an elastic plate, an insole and/or an outsole.

In some embodiments, at least some of the recessed pockets are in the transverse direction arranged one after another. Thus, in some embodiments, the recessed pockets form a grid, i.e. some recessed pockets are in the longitudinal direction arranged one after the other and some recessed pockets are in the transverse direction arranged one after another, i.e. next to each other. Such embodiments generally provide a more locally focused cushioning, thereby providing for a more efficient cushioning. For example, if the sportsperson performs a lunge with the right foot to the front and diagonally to the right, locally focused cushioning may be required on the medial side of the right foot depending on how the sportsperson treads and distributes it body weight.

In some embodiments, recessed pockets being in the transverse direction arranged one after another have a distance between each other of 20 mm to 50 mm, in particular 30 mm to 40 mm.

In some embodiments, each recessed pocket has a volume of 1500 $mm^2$ to 4000 $mm^2$, in particular of 2000 $mm^2$ to 3500 $mm^2$.

Furthermore, each of the recessed pockets may have a depth, i.e. an extension against the vertical direction, of 6 mm to 12 mm, in particular of 7.5 mm to 9.0 mm.

In some embodiments, the depth of each of the recessed pockets is between 30% and 50%, in particular between 35% and 45%, of the thickness of the midsole at the corresponding recessed pocket. The thickness of the midsole is the extension of the midsole, including for example circumferential rims or the like, along or against the vertical direction at the position at which the depth of the recessed pocket is measured.

In some embodiments, each of the recessed pockets may have a length of the pocket, i.e. an extension along the longitudinal direction, of 10 mm to 40 mm, in particular of 15 mm to 35 mm. The length of the pocket at the bottom may be smaller than at the top. For example, the length of each recessed pocket at the bottom may be between 15 mm to 20 mm and the length of the pocket at the top may be between 30 mm to 35 mm.

In some embodiments, the length of each of the recessed pockets is between 3% and 15%, in particular between 4.5% and 12.0%, of the length of the midsole. The length of the midsole is the extension of the midsole between the heel edge and the midsole tip along the longitudinal direction and the values typically apply for a midsole for a US 10 sized shoe, which may have a length of 300 to 305 mm, in particular 301 mm.

In some embodiments, each of the recessed pockets may have a width, i.e. an extension along the transverse direction, of 10 mm to 30 mm, in particular of 12 mm to 24 mm.

In some embodiments, the width of each of the recessed pockets is between 8% and 26%, in particular between 10% and 20%, of the width of the midsole at the corresponding recessed pocket. The width of the midsole is the distance of the midsole between the medial side and the lateral side along the transverse direction at the position at which the width of the recessed pocket is measured.

In some embodiments, the recessed pockets have a cross-section along the longitudinal direction and perpendicular to the transverse direction which has an essentially rectangular shape or an essentially trapezoidal shape. It is understood that the corners of the rectangular or the trapezoid may also be rounded.

In some embodiments, the midsole further comprises a central notch. The central notch extends in the longitudinal direction through the midfoot area and optionally from the forefoot area through the midfoot area into the heel area. The central notch is typically essentially arranged in the center of the midsole, i.e. in the transverse direction the central notch has essentially the same distance to the medial side and to the lateral side of the midsole. Typically, the central notch vertically penetrates the midsole, i.e. it may be considered as a through hole in the vertical direction. Preferably, the central notch is horizontally circumferentially surrounded by the midsole. Embodiments with such a central notch provide for a better cushioning, in particular for a locally focused cushioning, as the recessed pockets are more prone to collapse, because in particular the vertical walls of the pockets are more flexible and thus collapse to a greater extend.

In some embodiments, the central notch divides the midsole into a lateral portion and a medial portion. In certain embodiments, the lateral portion comprises recessed pockets which are in the longitudinal direction arranged one after another and the medial portion comprises recessed pockets which are in the longitudinal direction arranged one after another. Preferably, the medial portion comprises a single row of recessed pockets being in the longitudinal direction arranged one after another and the lateral portion comprises a single row of recessed pockets being in the longitudinal direction arranged one after another.

In some embodiments, the recessed pockets in the medial portion are symmetrically arranged to the recessed pockets in the lateral portion, in particular with respect to a central longitudinal axis.

In some embodiments, the recessed pockets are arranged in the forefoot area and optionally in the midfoot area. Preferably, the recessed pockets are arranged only in the forefoot area and optionally in the midfoot area. Thus, the heel area may be devoid of such recessed pockets.

In some embodiments, the midsole may in the heel area define one or more channels, Such channels may preferably extend in the transverse direction through the midsole. Thus, the channels may completely penetrate the midsole form the medial side to the lateral side. In the plane along the vertical direction and the longitudinal direction, the channels may each be circumferentially defined, respectively surrounded, by the midsole. Each channel may in some embodiments have an opening on the lateral side and an opening on the medial side, Such channels increase the cushioning effect of the midsole, as the midsole can be compressed more easily, thereby at least partially collapsing the channels. Providing such channels in the heel area is beneficial, because it is typically the heel area which first contacts the ground upon landing during walking or running.

In some embodiments, the shoe sole further comprises an elastic plate which is arranged on the top layer of the midsole. Thus, the elastic plate may be directly in contact with the midsole and it may in the vertical direction be at least partly arranged above the midsole. Particularly, the elastic plate is arranged in the operative, i.e. worn, state closer to the wearer's foot than the midsole. In particular, the elastic plate may be a rigid plate, e.g. a rigid elastic plate. For example, the elastic plate may be incompressible. The skilled person understands that an elastic plate is a plate which when being bent, i.e. being biased, it returns into its original shape. The elastic plate further comprises a plurality of protrusions, wherein at least some of these protrusions are inserted into the recessed pockets of the midsole. Preferably, each protrusion engages into a corresponding recessed pocket of the midsole. It has been observed that in such embodiments, the elastic recessed pocket and the elastic plate both deform upon landing, which provides for a cushioning effect. Additionally, the protrusion of the elastic plate in the correspondingly deformed recessed pocket is elastically deformed, i.e. biased. Upon push off, the protrusion returns to its original state which provides a propelling effect and thus enables an efficient force transmission. This has the advantage that even though efficient cushioning is achieved, almost no force is lost for push-off, or advantageously, although there is an efficient cushioning, push-off is still supported by the elastic plate and the protrusions. The plate preferably comprises a plate body, e.g. a flat and/or even plate body from which the protrusions protrude.

In some embodiments, only the protrusions are inserted into the recessed pockets and optionally into the central notch. In particular, the plate body is in the vertical direction arranged above the recessed pockets and thus outside the recessed pockets.

In some embodiments, one protrusion of the elastic plate is inserted in each recessed pocket of the midsole.

In some embodiments, the elastic plate may be integrally formed, i.e. it may be single-pieced.

In some embodiments, each protrusion forms a bulge forming a convexity towards the midsole and in particular towards the base layer of the midsole. The bulge is configured such during running it is upon landing elastically compressed in a vertical direction of the sole and is further configured such that it returns to its original shape upon push off. This allows for a forwardly directed propulsion and thus improves the force transmission. The original shape refers thereby to the shape of the bulge in an unbiased, i.e. unstressed state.

In some embodiments, the elastic plate comprises several bulges which are transversally or longitudinally offset to each other. Preferably, always between two transversally or between two longitudinally offset bulges is an even section of the elastic plate. An even section is a section of the elastic plate, which in particular along the longitudinal direction, does not comprise a bulge but extends evenly. All even sections form, preferably together, the plate body. In particular, such an even section may be essentially parallel to the midsole top layer or the midsole base layer. Such sections increase the stability upon landing.

The elastic plate may typically have an essentially constant thickness. Thus, the bulge is typically not significantly thicker than the rest of the plate. For example, the elastic plate may have at each of the bulges a thickness which is at most 3×, in particular at most 2×, in particular at most 1.5× the thickness in other areas of the plate.

The bulge may in some embodiments be curved, and in particular be bell shaped. In other embodiments, the bulge may have in the cross section along the longitudinal direction and perpendicular to the transverse direction of the sole have a U-shape, a V-shape or trapezoidal shape.

In some embodiments, the bulge is formed along the longitudinal direction but not along the transverse direction.

In some embodiments, the elastic plate extends along at least 50%, in particular along at least 75%, in particular along at least 85%, in particular along at least 95% or even along 100% of the total width, i.e. the extension along the transverse direction, of the midsole.

In some embodiments, the elastic plate extends along at least 50%, in particular along at least 75%, in particular along at least 85%, in particular along at least 95% or even along 100% of the total length, i.e. the extension along the longitudinal direction, of the midsole.

In some embodiments, the elastic plate has a thickness between 0.5 mm and 3.0 mm, in particular between 0.9 mm and 1.2 mm.

In some embodiments, one or more of the protrusions are inserted into the central notch and preferably through the central notch. In certain embodiments in which more than one protrusion is inserted into the central notch, the protrusions may along the longitudinal direction be arranged one after another. Preferably, the protrusions may be aligned with the base layer, i.e. in the vertical direction, thereby avoiding that the protrusion protrudes from the base layer of the midsole. Such embodiments have the advantage that both the lateral and medial stability is increased. Furthermore, the protrusions being inserted into the central notch may each form a bulge as described in the embodiments above, which in particular forms a convexity towards the midsole, respectively in the operative state to the ground. Also, such a bulge is configured such that during running it is elastically compressed in a vertical direction of the sole upon landing and that it returns to its original shape upon push off.

In some embodiments, the elastic plate has a greater hardness than the midsole. In some embodiments, the hardness of the elastic plate is between 60 Shore A and 100 Shore D, in particular between 70 Shore A to 100 Shore D.

The elastic plate may for example be made from a thermoplastic polyurethane, polyolefins, in particular polyethylene and polypropylene, polyester, polyester elastomers, polyamide, polyether block amide, carbon fiber and mixtures thereof. Additionally, the elastic plate may comprise reinforcement fibers for increasing the rigidity. These may for example be selected from linen, basalt, bamboo, hemp, cellulose, glass and carbon fibers as well as mixtures thereof.

In some embodiments, the midsole comprises a peripherally arranged support rim being configured for supporting the elastic plate. The support rim typically circumferentially surrounds the central notch of the midsole. The support rim may in some embodiments comprise a step. In some embodiments, the elastic plate may be directly attached to the support rim.

In some embodiments, the shoe sole further comprises an insole. In such embodiments, the elastic plate is typically arranged between the midsole and the insole. The insole may in some embodiments be continuous, respectively have a closed surface. Preferably, the insole completely covers the elastic plate. As the elastic plate is arranged between the insole and the midsole, the elastic plate is sandwiched between the insole and the midsole. The insole may be made of a polymeric material, for example polyurethane, polyester, polyolefins or polyamides or mixtures thereof.

In some embodiments, the midsole comprises transverse grooves or transverse slits extending along a transverse direction of the midsole. The grooves or slits are open towards the base layer and typically closed to the top layer, i.e. they are not visible when viewed on the top layer of the midsole. In some embodiments, the transverse grooves or transverse slits penetrate the midsole in the transverse direction. The transverse grooves or transverse slits are typically not completely penetrating in the vertical direction through the midsole. The depth, i.e. the extension in the vertical direction, of the transverse grooves or transverse slits may in some embodiments be between 5 mm to 20 mm, in particular between 10 mm to 15 mm.

A groove as used herein has typically a greater width than a slit. For example, a groove may have a width of 5 mm to 40 mm, in particular of 5 mm to 20 mm and a slit may have a width from 0.3 mm to 1.5 mm, in particular from 0.5 mm to 0.7 mm.

In some embodiments, at least some of the transverse grooves or transverse slits are arranged between two recessed pockets which are arranged one after another, thereby segmenting the midsole into multiple blocks. Typically, at least some or all of the blocks each comprise at least one recessed pocket, in particular only a single recessed pocket. The blocks may in some embodiments further be segmented into medial blocks and lateral blocks by the central notch as it is described for some embodiments above. Segmenting the midsole into multiple blocks, each comprising a recessed pocket increases the cushioning efficiency, because due to the segmentation, the blocks are more prone to collapse under the forces occurring during sportive activity. In addition, the combined segmentation by the transverse grooves or transverse slits and the central notch, which provides lateral blocks and medial blocks provides for a locally focused cushioning, which is particularly beneficial for gymnastic activities or cross-fit movements, such as steps, jumps, lunges or squats.

In some embodiments, the midsole comprises at its lateral side and/or at its medial side a horizontal tilting slit which divides the midsole into a midsole top portion and a midsole base portion and which is configured to tilt the midsole top portion with respect to the midsole base portion. Preferably, the midsole comprises two of such horizontal tilting slits, i.e. one tilting slit at the medial side and one tilting slit at the lateral side. The midsole top portion is the part of the midsole which is in the vertical direction arranged above the tilting slit and the midsole base portion is the part of the midsole being in the vertical direction arranged below the titling slit. Such slits are advantageous for gymnastic or cross-fit movements, as they prevent foot injuries and provide for an improved flexibility. For example, if a sportsperson does the splits, a horizontal tilting slit on the lateral side allows that the base layer of the midsole is parallel to the ground and completely contacts the ground (either directly or via an outsole). The tilting slits allow the midsole top portion to be tilted with respect to the midsole bottom portion by widening the angle between them, Thereby, the sportsperson has a stable stand, which prevents injuries and provides a much more comfortable feeling. The same holds, for example, true for sidestep movements.

Typically, the horizontal tilting slit is arranged such that the midsole top portion can be tilted with respect to the midsole base portion around a tilting axis extending in the longitudinal direction of the midsole.

In some embodiments, the horizontal tilting slit is arranged in the midfoot area of the midsole. In particular, the horizontal tilting slit, respectively the horizontal tilting slits are only arranged in the midfoot area.

In some embodiments, the horizontal tilting slit, respectively each of the horizontal tilting slits, may have a depth, i.e. an extension along the transverse direction of 3 mm, to 25 mm, in particular of 5 mm to 8 mm.

In some embodiments, the horizontal tilting slit, respectively each of the horizontal tilting slits, may have a height, i.e. an extension along the vertical direction of 0.3 mm, to 1.5 mm, in particular of 0.5 mm to 0.7 mm.

The horizontal tilting slits are in the transverse direction not penetrating completely through the midsole. For example, the depth of the horizontal tilting slit, respectively of each of the horizontal tilting slits, may be between 4% and 25%, in particular between 5% and 12% of the total width at the position of the corresponding slit of the midsole. The total width refers to the distance between the lateral side and the medial side of the midsole at the position of the horizontal tilting slit.

In some embodiments, the shoe sole further comprises an outsole being mounted on the base layer of the midsole. The outsole is thus mounted to the midsole such that in an operative state, the outsole contacts the ground. The outsole may either fully cover the midsole or only a portion thereof, for example at most 80%, or at most 70%, or at most 50% if the midsole. In some embodiments, the outsole may be arranged in the heel area, in particular only in the heel area. In certain embodiments, the outsole may be made of a material with a hardness of 55 Shore A to 80 Shore A, in particular of 65 Shore A to 70 Shore A. Suitable materials for the outsole may for example be rubber, polyether block amide, polyamide or polyurethane. The outsole may in some embodiments consists of separate outsole portions. These outsole portions may be spatially separated from each other and form together the outsole.

BRIEF DESCRIPTION OF SEVERAL VIEWS OF THE DRAWINGS

The herein described invention will be more fully understood from the detailed description given herein below and the accompanying drawings which should not be considered limiting to the invention described in the appended claims.

DETAILED DESCRIPTION OF THE INVENTION

Figure 1:
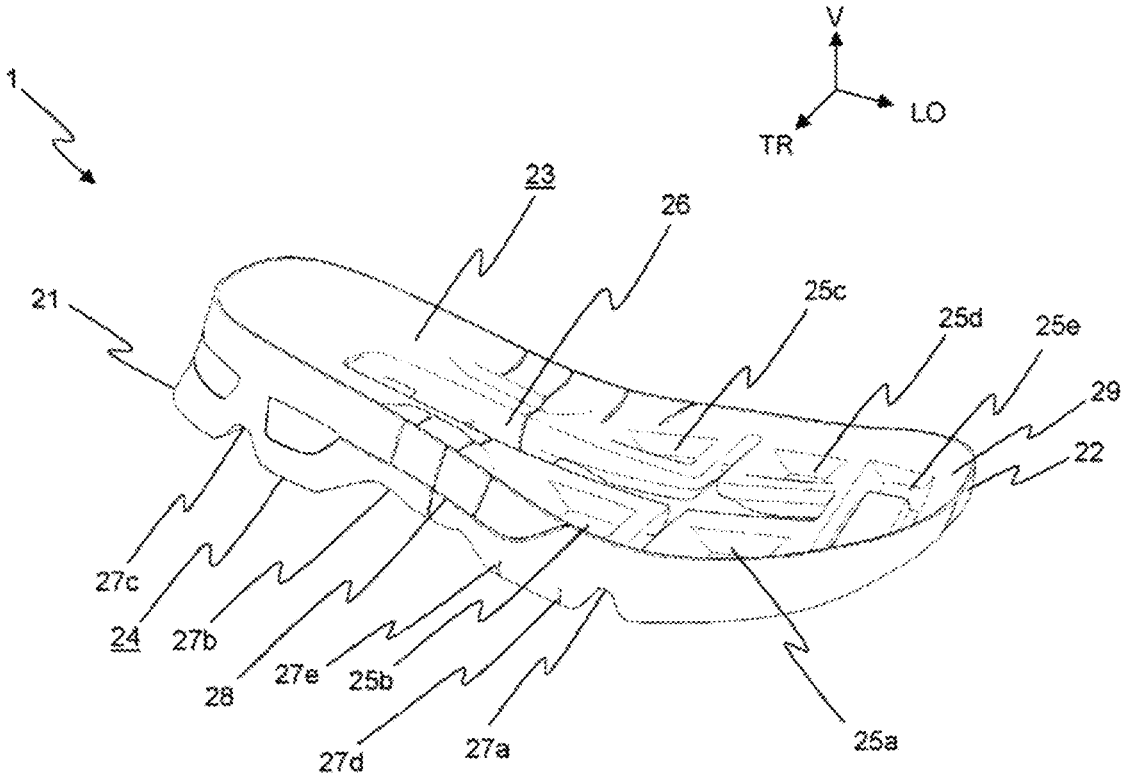
FIG. 1 shows a perspective shoe sole according to an embodiment of the invention.

FIG. 1 shows shoe sole 1 comprising midsole 2. Midsole 2 comprises heel edge 21 and midsole tip 22. Longitudinal direction LO of midsole 2, respectively of shoe sole 1, extends from heel edge 21 to midsole tip 22. Midsole 2 further comprises top layer 23 and oppositely arranged base layer 24. The midsole further defines five recessed pockets 25*a*, 25*b*, 25*c*, 25*d* and 25*e* which each are open towards top layer 23. Recessed pockets 25*a* and 25*b* are in longitudinal direction LO arranged behind one another. In the same manner, recessed pockets 25*c* and 25*d* are in the longitudinal direction LO arranged one after the other.

Midsole 2 further comprises central notch 26, which divides the midsole into a lateral portion extending between the central notch and the laterally sided periphery of the midsole and a medial portion extending between the central notch and the medially sided periphery of the midsole.

Midsole 2 further comprises, respectively defines, transverse grooves 27*a*, 27*b* and 27*c* which extend in the transverse direction TR of midsole 2 and which are open towards base layer 24. Furthermore, midsole 2 comprises transverse slits 27*d* and 27*e* which also extend in the transverse direction TR of the midsole and thus essentially in parallel to transverse grooves 27*a*, 27*b* and 27*c*. As can be seen, transverse slits 27*d* and 27*e* have a smaller width than transverse groves 27*a*, 27*b* and 27*c* and/or as notch 26. Transverse groove 27*a* is arranged between the two recessed pockets 25*a* and 25*b* and also between the two recessed pockets 25*c* and 25*d*, which increases the cushioning effect provided by these pockets.

Arranged on the lateral side of the midsole is horizontal tilting slit 28. This tilting slit divides midsole 2 in a midsole top portion and a midsole base portion such that the midsole top portion is arranged in the vertical direction V above midsole base portion. Horizontal tilting slit 28 is configured such that it can tilt the midsole top portion with respect to the midsole base portion, i.e. such that the distance between the midsole top portion and the midsole base portion increases.

Figure 2:
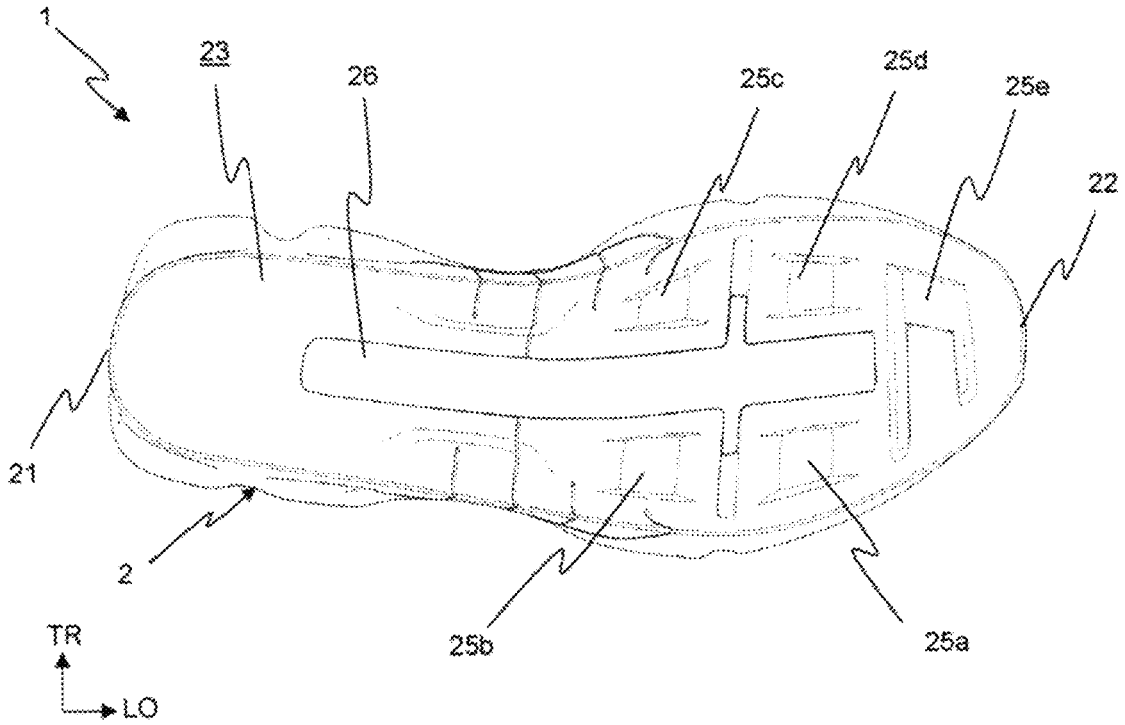
FIG. 2 shows a top view of the shoe sole of FIG. 1.

FIG. 2 depicts a top view of shoe sole 1 with midsole 2 shown in FIG. 1. As can be seen, notch 26 is centrally arranged, i.e. the distance in transverse direction TR between the notch and the lateral sided periphery of the midsole is essentially the same as the distance in transverse direction TR between the notch and the medial sided periphery of the midsole.

Figure 3:
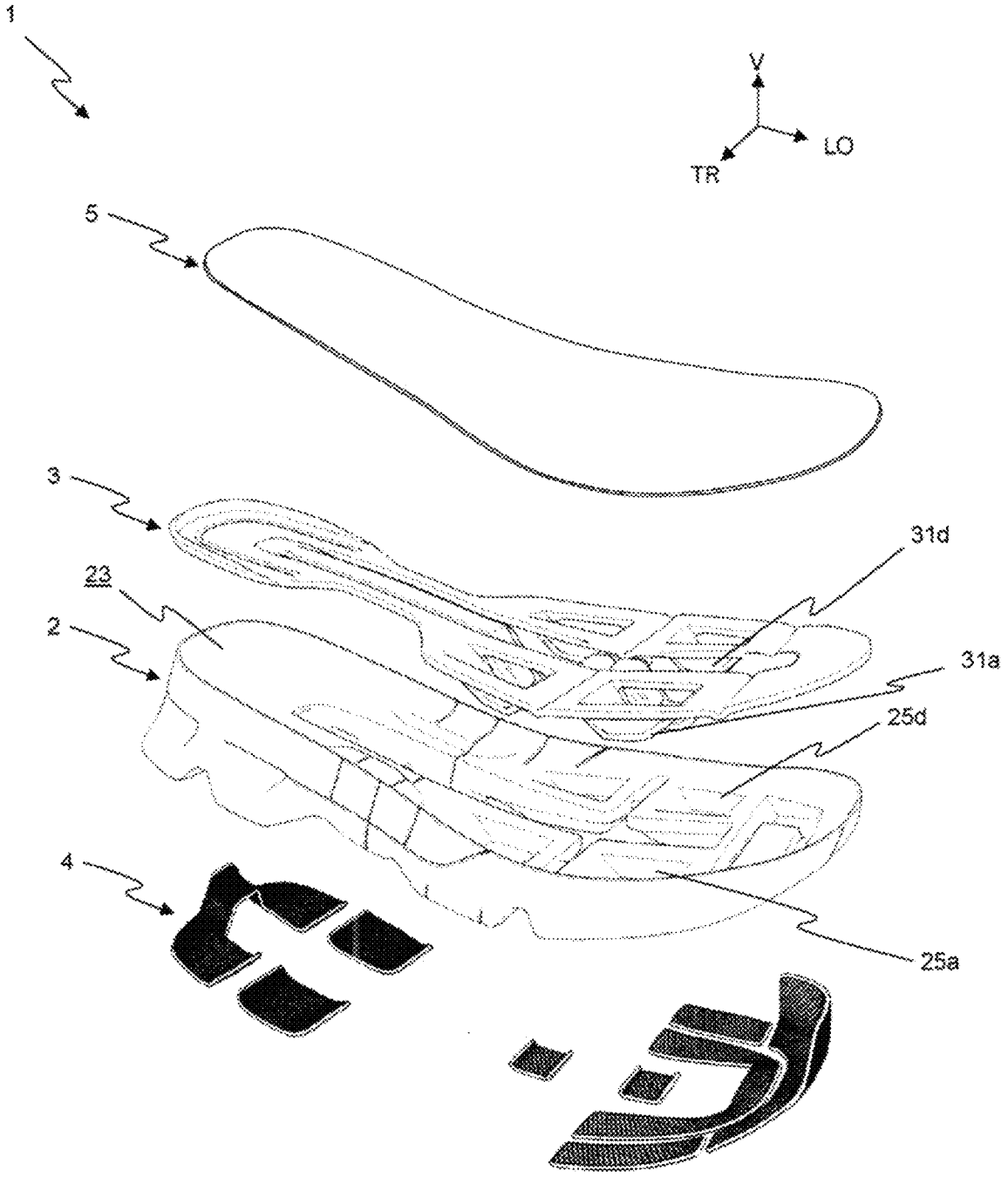
FIG. 3 shows an exploded view of a shoe sole according to another embodiment of the invention.

FIG. 3 shows an exploded view of shoe sole 1 according to another embodiment of the invention. In this embodiment, shoe sole 1 comprises not only midsole 2, which may for example be the midsole shown in FIGS. 1 and 2, but additionally also outsole 4 which covers at least parts of base layer 24 of midsole 2 (cf. FIG. 1). Furthermore, shoe sole 1 comprises elastic plate 3 which may be an elastic and incompressible plate. Elastic plate 3 is arranged on top layer 23 of midsole 2 and in particular directly on top layer 23.

Elastic plate 3 comprises protrusions, such as protrusion 31*a* and 31*d* which are inserted into the recessed pockets of midsole 2. As can be seen, protrusion 31*a* is inserted into recessed pocket 25*a* which is arranged in the lateral portion of midsole 2 and protrusion 31*d* is inserted into recessed pocket 25*d* which is arranged in the medial portion of midsole 2. The protrusions form a bulge forming a convexity towards midsole 2, respectively in general towards base layer 24 of midsole 2.

Shoe sole 1 also comprises insole 5, which is in the vertical direction V arranged on elastic plate 3. Thus, elastic plate 3 is arranged between midsole 2 and insole 5.

Figure 4:
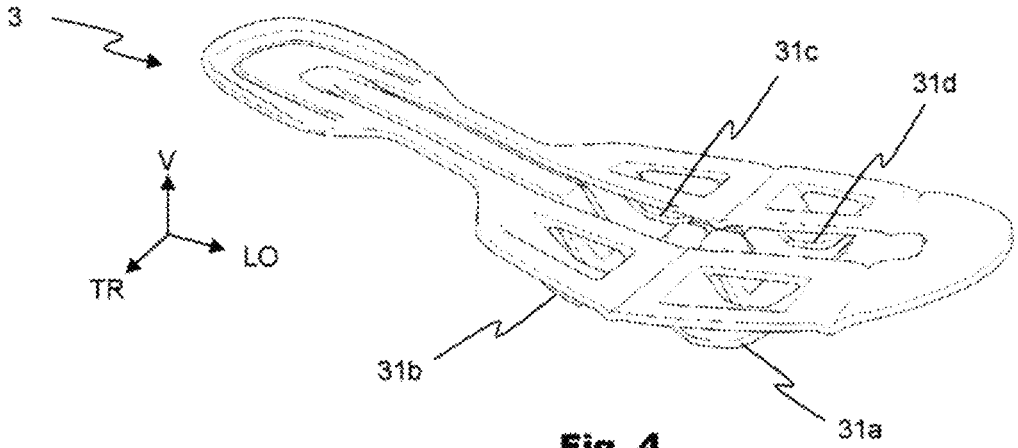
FIG. 4 shows a perspective view of an elastic plate as it is included in a shoe sole according to some embodiments of the invention.

FIG. 4 shows an embodiment of elastic plate 3 as it may be used in a shoe sole 1 according to any of the embodiments described herein. Elastic plate 3 comprises protrusions 31*a*, 31*b*, 31*c* and 31*d*. In general, at least the protrusions being inserted into recessed pockets of midsole 2 have a shape which corresponds to the shape of the recessed pocket. In other words, the corresponding protrusion generally fits into the recessed pocket in which it is inserted and may contact the midsole defining the recessed pockets. The protrusions form a bulge which forms a convexity.

Figure 5:
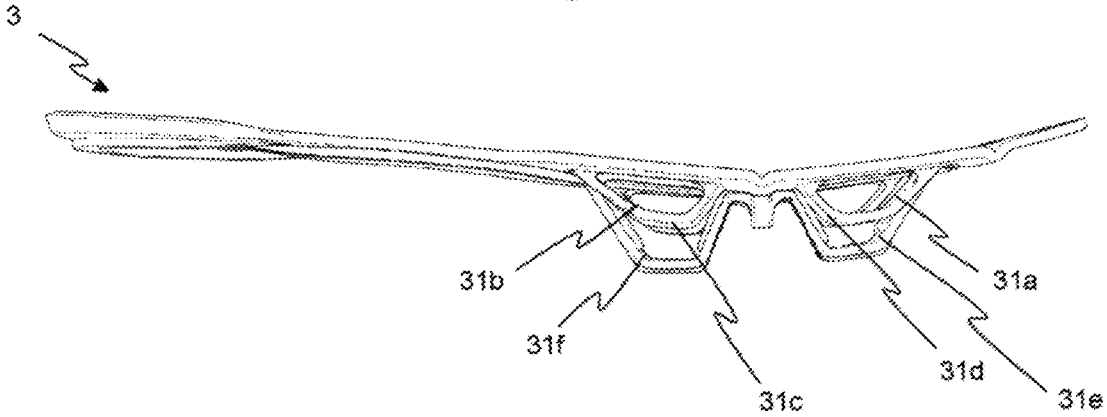
FIG. 5 shows a side view on the lateral side of the elastic plate of FIG. 4.

FIG. 5 shows a side view on the lateral side of elastic plate 3 shown in FIG. 4. As can be seen, elastic plate 3 does not only comprise protrusions 31*a*. 31*b*, 31*e* and 31*d* which are inserted into recessed pockets, but also protrusions 31*e* and 31*f*, which are inserted into central notch 26 of midsole 2 (cf. FIGS. 7 and 8). Also, protrusions 31*e* and 31*f* being inserted into central notch 26 are in the longitudinal direction arranged one after the other, i.e. behind each other.

Figure 6:
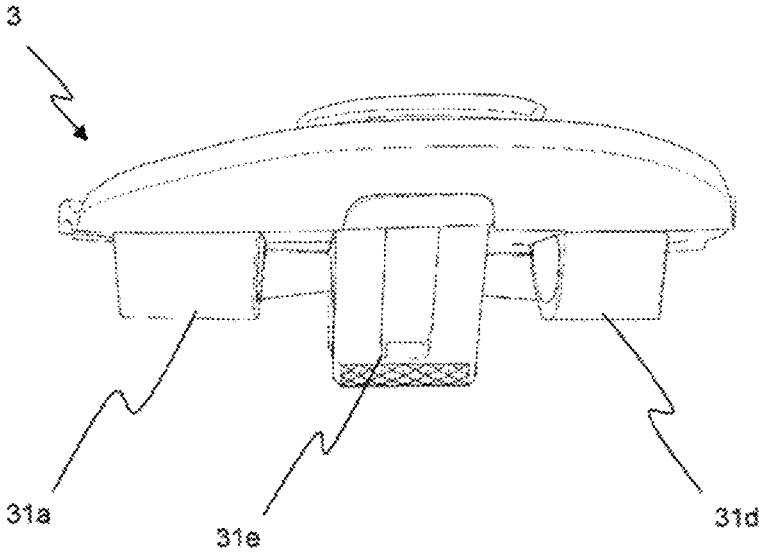
FIG. 6 shows a front view of the elastic plat of FIGS. 4 and 5.

FIG. 6 shows a front view of elastic plate 3 in which it can be seen that protrusions 31*a* and 31*d*, which are inserted into recessed pockets of midsole 2, sandwich protrusion 31*e* which is inserted into central notch 26, i.e. protrusion 31*d* is in the transverse direction arranged between protrusion 31*a* and 31*d*. Furthermore, the protrusions are in the transverse direction spaced apart from each other. All of these protrusions each form a bulge forming a convexity.

Figure 7:
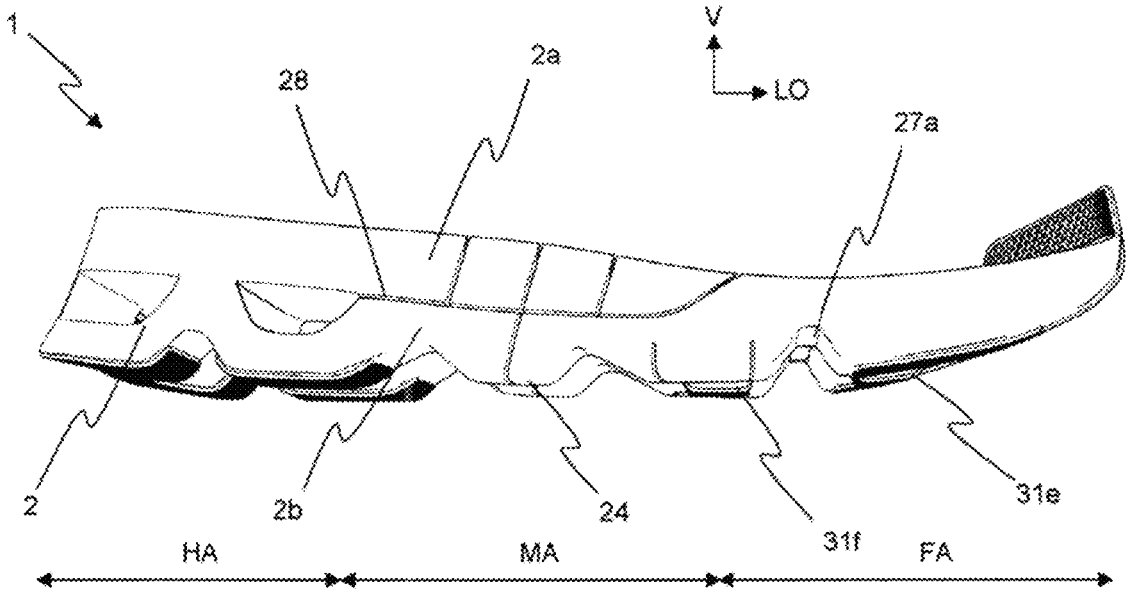
FIG. 7 shows a side view on the lateral side of a shoe sole according to another embodiment of the invention.

FIG. 7 shows a side view of a shoe sole 1 according to another embodiment of the invention, Shoe sole 1 comprises midsole 2 which may for example be a midsole as shown in FIGS. 1 and 2. Midsole 2 comprises transverse groove 27*a* which is open towards base layer 24, respectively in the operative, i.e. worn, state to the ground. Furthermore, it can be seen that protrusions 31*e* and 31*f*, which are inserted into central notch 24 of midsole 2 (see for example FIG. 3), penetrate through central notch 26. However, in this and optionally also in any other embodiment as described herein, the protrusion(s) being inserted into central notch 26 and penetrating through central notch 26 are aligned with base layer 24, i.e. they do not protrude from midsole 2, thereby generating an even contact surface for contacting the ground. Furthermore, as the central notch penetrates midsole 2, protrusions 31*e* and 31*f* are visible from the bottom side, i.e. when viewed onto base layer 24. FIG. 7 further shows that midsole 2 comprises a heel area HA, a forefoot area FA and a midfoot area MA arranged between the heel area and the forefoot area. Furthermore, horizontal tilting slit 28 is shown, which divides midsole 2 into a midsole top portion 2*a* and midsole base portion 2*b* which are arranged on top of each other.

Figure 8:
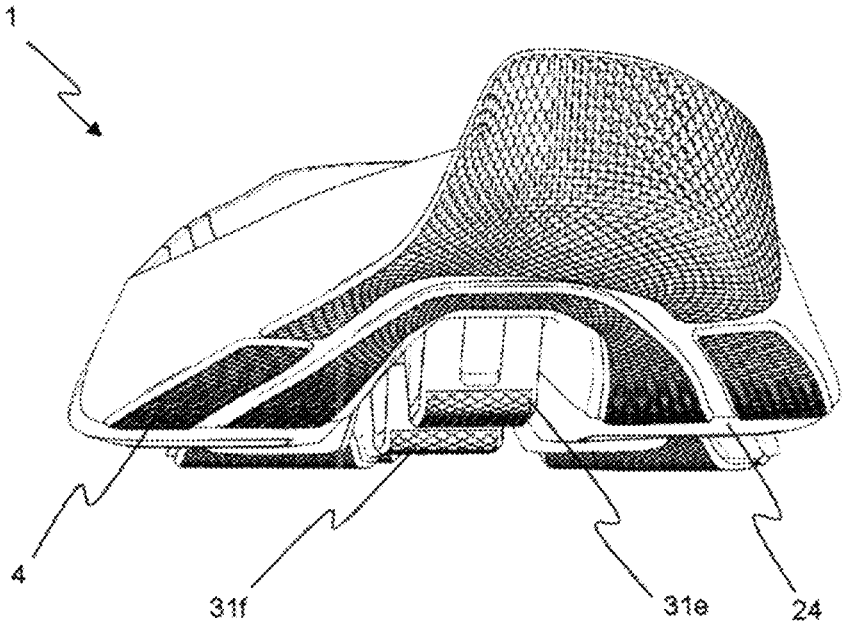
FIG. 8 shows a front view of the shoe sole of FIG. 7.

FIG. 8 shows a front view of shoe sole 1 shown in FIG. 7. Also, in this figure it can be seen that protrusions 31*e* and 31*f* extend through the central notch and are aligned with base layer 24. Furthermore, protrusions 31*e* and 31*f* and also base layer 24 are covered by portions of outsole 4.

The invention claimed is:

1. A shoe sole for a sport shoe, the shoe sole comprising a midsole, the midsole comprising:

a. a forefoot area, a heel area and a midfoot area arranged between the forefoot area and the heel area;

b. a heel edge and a midsole tip, wherein a longitudinal direction of the midsole extends from the heel edge to the midsole tip;

c. a top layer and a base layer, wherein the midsole defines a plurality of recessed pockets which are open towards the top layer and wherein at least some of the recessed pockets are in the longitudinal direction arranged one after another;

d. a central notch which penetrates the midsole as a through hole in a vertical direction; and e. an elastic plate arranged on the top layer of the midsole, wherein the elastic plate comprises one or more protrusions wherein at least one of the protrusions is inserted into and through the central notch.

2. The shoe sole according to claim 1, wherein the central notch extends from the forefoot area through the midfoot area to the heel area.

3. The shoe sole according to claim 2, wherein the central notch divides the midsole into a lateral portion and a medial portion.

4. The shoe sole according to claim 1, wherein the recessed pockets are arranged in the forefoot area and in the midfoot area.

5. The shoe sole according to claim 1, wherein at least some of the protrusions are inserted into the recessed pockets of the midsole.

6. The shoe sole according to claim 5, wherein each protrusion forms a bulge forming a convexity towards the midsole, towards the base layer of the midsole, wherein the bulge is configured such that during running it is elastically compressed in a vertical direction of the shoe sole upon landing and that it returns to its original shape upon push off.

7. The shoe sole according to claim 1, wherein the elastic plate (3) has a hardness between 70 Shore A to 100 Shore D.

8. The shoe sole according to claim 1, wherein the midsole comprises a peripherally arranged support rim configured for supporting the elastic plate.

9. The shoe sole according to claim 1, wherein the shoe sole further comprises an insole, wherein the elastic plate is arranged between the midsole and the insole.

10. The shoe sole according to claim 1, wherein the midsole comprises transverse grooves and/or transverse slits extending along a transverse direction of the midsole, wherein the transverse grooves or transverse slits are open towards the base layer.

11. The shoe sole according to claim 10, wherein at least some of the transverse grooves or transverse slits are arranged between two recessed pockets which are arranged one after another, thereby segmenting the midsole into multiple blocks.

12. The shoe sole according to claim 1, wherein the midsole comprises at its lateral side and/or its medial side a horizontal tilting slit which divides the midsole into a midsole top portion and a midsole base portion and which is configured to tilt the midsole top portion with respect to the midsole base portion.

13. The shoe sole according to claim 12, wherein the horizontal tilting slit is arranged in the midfoot area of the midsole.

14. The shoe sole according to claim 1, wherein the elastic plate has a greater hardness than the midsole and/or wherein the hardness is between 60 Shore A and 100 Shore D.

15. The shoe sole according to claim 1 wherein one or more protrusions extending through the central notch are aligned with the base layer in the vertical direction.

16. The shoe sole according to claim 1 wherein one or more protrusions contact the ground during running.

* * * * *